US011333454B2

(12) United States Patent
Pokalyaev

(10) Patent No.: US 11,333,454 B2
(45) Date of Patent: May 17, 2022

(54) AUTOMATIC FIREARM WITH INERTIAL AUTOMATIC LOADING SYSTEM

(71) Applicants: Vasilij Mihajlovich Pokalyaev, Kachkanar (RU); Sergei Pokalyaev, Kachkanar (RU)

(72) Inventor: Vasilij Mihajlovich Pokalyaev, Kachkanar (RU)

(73) Assignees: Vasilij Mihajlovich Pokalyaev, Kachkanar (RU); Seraei Pokai Yafv, Kachkanar (RU)

( * ) Notice: Subject to any disclaimer, the term of this patent is extended or adjusted under 35 U.S.C. 154(b) by 0 days.

(21) Appl. No.: 17/284,443

(22) PCT Filed: Dec. 17, 2019

(86) PCT No.: PCT/RU2019/000955

§ 371 (c)(1),
(2) Date: Apr. 10, 2021

(87) PCT Pub. No.: WO2020/139149

PCT Pub. Date: Jul. 2, 2020

(65) Prior Publication Data

US 2021/0356222 A1 Nov. 18, 2021

(30) Foreign Application Priority Data

Dec. 25, 2018 (RU) ..... 2018146737

(51) Int. Cl.

| | |
|---|---|
| ***F41A 3/54*** | (2006.01) |
| ***F41A 3/82*** | (2006.01) |
| ***F41A 5/02*** | (2006.01) |

(52) U.S. Cl.

CPC ..... *F41A 3/54* (2013.01); *F41A 3/82* (2013.01); *F41A 5/02* (2013.01)

(58) Field of Classification Search

CPC ..... F41A 3/14; F41A 3/20; F41A 3/78; F41A 3/82; F41A 5/02

See application file for complete search history.

(56) References Cited

U.S. PATENT DOCUMENTS

| | | | | |
|---|---|---|---|---|
| 7,478,495 | B1 * | 1/2009 | Alzamora | F41C 23/04 42/74 |
| 8,752,474 | B2 | 6/2014 | Vanek | |

(Continued)

FOREIGN PATENT DOCUMENTS

| | | |
|---|---|---|
| RU | 2478177 C2 | 3/2013 |
| RU | 2626771 C2 | 8/2017 |
| RU | 2636186 C2 | 11/2017 |

*Primary Examiner* — J. Woodrow Eldred
(74) *Attorney, Agent, or Firm* — John Alumit

(57) ABSTRACT

The present invention relates to the field of military technology, and more particularly to an automatic firearm. Said firearm consists of a receiver, a barrel, a bolt carrier and a bolt, a bumper spring on the bolt carrier, a recoil spring between the bolt carrier and the rear wall of the receiver, a trigger mechanism, an ammunition feed mechanism, sighting equipment, a device for locking the bumper spring in a compressed state caused by the bolt carrier striking the front wall of the receiver or the barrel or the bolt via the bumper spring, and a mechanism for synchronizing the release of the bumper spring with the firing of a shot. Additionally, the firearm can be provided with an additional bumper spring between the bolt carrier and the rear wall of the receiver, and a lever for compressing and subsequently releasing said additional bumper spring in case the manual reloading in order to impart additional kinetic energy to the bolt carrier for the forward movement thereof, wherein said lever can be combined with a recharging handle. Additionally, the firearm can be provided with an additional device for locking the bumper spring in a compressed state caused by the bolt carrier striking the rear wall of the receiver via the bumper (Continued)

spring, and a lever for compressing and subsequently locking the bumper spring during the rearward movement of the bolt carrier in the case of manual reloading, wherein said lever can be combined with a recharging handle. The technical result provided by the above combination of features is the creation of a firearm having an inertial automatic loading system that functions reliably and consistently due to the increased reloading system working speeds and increased recovery of recoil energy.

5 Claims, 1 Drawing Sheet

(56) References Cited

U.S. PATENT DOCUMENTS

| | | | | |
|---|---|---|---|---|
| 2018/0112942 | A1* | 4/2018 | Iwasawa | F41A 17/36 |
| 2019/0293379 | A1* | 9/2019 | Taylor | F41A 25/12 |
| 2021/0156633 | A1* | 5/2021 | Durham, III | F41A 3/70 |

* cited by examiner

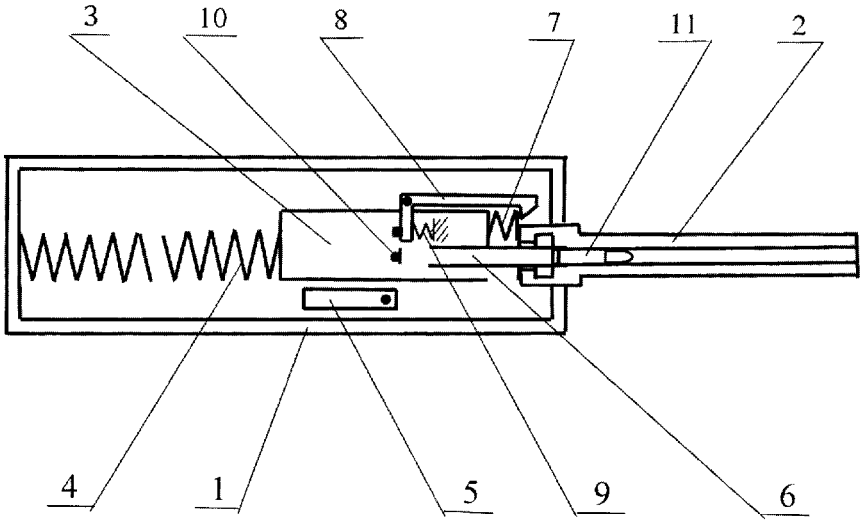
3
10
8
7
11
2
4
1
5
9
6

AUTOMATIC FIREARM WITH INERTIAL AUTOMATIC LOADING SYSTEM

BACKGROUND

The present invention relates to the field of military technology, and more particularly to an automatic firearm [F41C 7/00, F41C3/00, F41A21/00].

With the present background of invention we are familiar with an automatic rifle with inertial automatic loading system, designed by Carl Sjogren (NUMBERS 739, 732 PATENTED 22 Sep. 1903. O.A.T. SJOGREN. AUTOMATIC GUN. APPLICATION FILED 13 Jul. 1901).

The rifle with inertial automatic loading system consists of a receiver, a barrel, a massive bolt carrier with a bolt, a bumper spring between a bolt carrier and the front wall of the receiver, a recoil spring between the bolt carrier and the rear wall of the receiver, trigger mechanism, an ammunition feed mechanism, a stock, a sighting equipment.

The rifle functions as follows: The bolt carrier and the bolt are retracted, the trigger mechanism is cocked, the recoil spring is compressed, the bolt carrier with the bolt move forward, a bullet is supplied to a bullet chamber, the bolt is locked. For making a shot, the trigger is pulled, under the recoil force the rifle moves rearward, the front wall of the receiver impacts the bolt carrier via the bumper spring, and the bolt carrier, having received the impulse, moves rearward, the bolt is unlocked, an empty case is ejected, the trigger mechanism is cocked, the recoil spring is compressed, the recoil spring pushes the bolt carrier with the bolt forward from the rearward position, the bullet is supplied to the bullet chamber, the bolt is locked, the rifle is ready for the next shot.

The disadvantageous feature of the present technical solution is unreliable and unstable function of the reloading system.

The objective, which the declared invention is oriented to, is the creation of the design of an automatic firearm with inertial automatic reloading system having reliable and stable loading system functioning.

The present objective can be solved through the installation of the following parts in a gun: a receiver, a barrel, a bolt carrier with a bolt, a bumper spring in the bolt carrier, a recoil spring between the bolt carrier and the rear wall of the receiver, a trigger mechanism, an ammunition feed mechanism, a sighting equipment, a device for locking the bumper spring in a compressed state, caused by the bolt carrier striking the front wall of the receiver or the barrel or the bolt via the bumper spring, and a mechanism for synchronizing the release of the bumper spring with the firing of a shot.

Additionally, the firearm can be provided with an additional bumper spring between the bolt carrier and the rear wall of the receiver, and a lever for compressing and subsequently releasing said additional bumper spring in case the manual reloading in order to impart additional kinetic energy to the bolt carrier for the forward movement thereof, wherein said lever can be combined with a recharging handle.

Additionally, the firearm can be provided with an additional device for locking the bumper spring in a compressed state caused by the bolt carrier striking the rear wall of the receiver via the bumper spring, and a lever for compressing and subsequently locking the bumper spring during the rearward movement of the bolt carrier in the case of manual reloading, wherein said lever can be combined with a recharging handle.

SUMMARY

The gun functions as follows: the bolt carrier and the bolt are retracted, the trigger mechanism is cocked, the recoil spring is compressed, the bolt carrier with the bolt, being in a rearward position, are released and move forward under the impact of the recoil spring, a bullet is supplied to a bullet chamber, the bolt is locked, the bolt carrier impacts the front wall of the receiver or the barrel or the bolt via the bumper spring, the bumper spring is compressed, the device for locking bumper spring locks it in a compressed state. The shot is made through pulling a trigger, under the recoil force the gun moves rearward, the front wall of the receiver or the barrel or the bolt impacts the bolt carrier via the bumper spring, a mechanism for synchronizing the bumper spring unlocking with the firing of a shot releases it, the bolt carrier having receiver kinetic power from gun recoil and compressed bumper spring, moves rearward, the bolt is unlocked, the empty case is rejected, the trigger mechanism is cocked, the recoil spring is compressed, the bolt carrier with the bolt move forward from the rearward position under recoil spring impact, the bullet is supplied to the bullet chamber, the bolt is locked, the bolt carrier impacts the front wall of the receiver or the barrel or the bolt via the bumper spring, the bumper spring is compressed, the device for locking bumper spring locks it in a compressed state, the gun is ready for the next shot. The loading system will continue shooting until the trigger guard is released or the ammunition is finished.

If an additional bumper spring and a lever for compressing at manual reloading of the additional bumper spring are additionally installed in the gun, it functions as follows: the bolt carrier and the bolt are retracted, the trigger mechanism is cocked, the recoil spring is compressed, the lever compresses additional bumper spring and releases it in the rearward position of the bolt carrier and the bolt, the additional bumper spring pushes the bolt carrier and the bolt, conferring them kinetic energy, the bolt carrier and the bolt move forward under the recoil spring impact, a bullet is supplied to a bullet chamber, the bolt is locked, the bolt carrier impacts the front wall of the receiver or the barrel or the bolt via the bumper spring, the bumper spring is compressed, the device for locking bumper spring locks it in a compressed state. The shot is made through pulling a trigger, under the recoil force the gun moves rearward, the front wall of the receiver or the barrel or the bolt impacts the bolt carrier via the bumper spring, a mechanism for synchronizing the bumper spring unlocking with the firing of a shot releases the bumper spring, the bolt carrier having receiver kinetic power from gun recoil and compressed bumper spring, moves rearward, the bolt is unlocked, the empty case is rejected, the trigger mechanism is cocked, the recoil spring is compressed, the bolt carrier and the bolt, being in the rearward position, impact the rear wall of the receiver via the additional bumper spring and having received additional kinetic power from the additional bumper spring move forward under the recoil spring impact, the bullet is supplied to the bullet chamber, the bolt is locked, the bolt carrier impacts the front wall of the receiver or the barrel or the bolt via the bumper spring, the bumper spring is compressed, the device for locking bumper spring locks it in a compressed state, the gun is ready for the next shot.

If an additional device for locking a bumper spring in a compressed state and a lever for compressing at manual reloading of the bumper spring are additionally installed in the gun, it functions as follows: the bolt carrier and the bolt are retracted, the trigger mechanism is cocked, the recoil spring is compressed, the lever compresses the bumper spring in the rearward position of the bolt carrier with the bolt, the additional device for locking bumper spring locks it in a compressed state, the bolt carrier with the bolt are released and move forward under the impact of the recoil spring, a bullet is supplied to a bullet chamber, the bolt is locked, the bolt carrier impacts the front wall of the receiver or the barrel or the bolt via the bumper spring, the bumper spring is compressed, the device for locking bumper spring locks it in a compressed state. The shot is made through pulling a trigger, under the recoil force the gun moves rearward, the front wall of the receiver or the barrel or the bolt impacts the bolt carrier via the bumper spring, a mechanism for synchronizing the bumper spring unlocking with the firing of a shot releases the bumper spring, the bolt carrier having receiver kinetic power from gun recoil and compressed bumper spring, moves rearward, the bolt is unlocked, the empty case is rejected, the trigger mechanism is cocked, the recoil spring is compressed, the bolt carrier with the bolt, being in the rearward position, impact the rear wall of the receiver via the bumper spring, the bumper spring is compressed, the additional device for locking bumper spring locks it in a compressed state, the bolt carrier with the bolt move forward under the recoil spring impact, the bullet is supplied to the bullet chamber, the bolt is locked, the bolt carrier impacts the front wall of the receiver or the barrel or the bolt via the bumper spring, the bumper spring is compressed, the device for locking bumper spring locks the bumper spring in a compressed state, the gun is ready for the next shot.

The technical result provided by the above combination of features is the creation of a firearm having an inertial automatic loading system that functions reliably and consistently due to the increased reloading system working speeds and increased recovery of recoil energy.

DRAWING

FIG. 1 is a diagram of the design illustrating the combined device for locking the bumper spring in a compressed state and the mechanism of synchronizing the release of the bumper spring with the firing of a shot, brought into operation by the simultaneous impact of the trigger to the trigger mechanism and mechanism guard.

BRIEF DESCRIPTION OF THE DRAWING

The following is installed into a gun receiver (i. 1): a barrel (i. 2), a bolt carrier (i. 3), a recoil spring (i. 4), a trigger of a trigger mechanism (i. 5). The following is installed into a bolt carrier: a bolt (i. 6), a bumper spring (i. 7), a combined device for locking bumper spring in a compressed state and a mechanism for synchronization of the release of the bumper spring with the firing of a shot (i. 8), a pulling spring of combined device and mechanism (i. 9). The bolt is provided with a hammer (i. 10). The bullet is forced into the barrel (i. 11).

The design working order is identical to the one mentioned above.

The design of the mechanism for synchronization of the release of the bumper spring with the firing of a shot can be made under the principle of selection of a gun recoil moment.

The invention claimed is:

1. The automatic firearm with inertia operated recoil system, comprising a receiver (1), a barrel (2), a bolt carrier (3) and a bolt (6), a bumper spring (7) on the bolt carrier, a recoil spring (4) between the bolt carrier (3) and a rear wall of the receiver (1), a trigger mechanism (5), a device for locking said bumper spring in a compressed state and that also operates as a synchronization mechanism that releases the bumper spring upon firing of a shot (8), and an ammunition feed mechanism, wherein said compressed state results from impact of the bolt carrier (3) to a front wall of the receiver, by impact of the bolt carrier (3) to the barrel (2), or by impact of the bolt carrier (3) to the bolt (6), via the bumper spring (7).

2. The automatic firearm according to claim 1, wherein said firearm contains an additional bumper spring between the bolt carrier and the rear wall of the receiver.

3. The automatic firearm according to claim 1, wherein said firearm contains an additional device for locking the bumper spring in a compressed state.

4. The automatic firearm according to claim 1 wherein said firearm contains a lever for compressing at manual reloading of an additional bumper spring for the purpose of supplying the bolt carrier with additional kinetic power for moving forward, which may be combined with a handle for the gun reloading.

5. The automatic firearm according to claim 1, contains a lever for compressing at manual reloading of the bumper spring with further locking, when the bolt carrier moves rearward, which may be combined with a handle for gun reloading.

* * * * *